US010508501B2

(12) United States Patent
Tilleman

(10) Patent No.: US 10,508,501 B2
(45) Date of Patent: Dec. 17, 2019

(54) DRILL BIT HAVING SHEAR CUTTERS WITH REDUCED DIAMETER SUBSTRATE

(71) Applicant: VAREL INTERNATIONAL IND., L.P., Carrollton, TX (US)

(72) Inventor: Daniel Michael Tilleman, Calgary (CA)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 169 days.

(21) Appl. No.: 15/837,103

(22) Filed: Dec. 11, 2017

(65) Prior Publication Data

US 2018/0202232 A1 Jul. 19, 2018

Related U.S. Application Data

(60) Provisional application No. 62/447,475, filed on Jan. 18, 2017.

(51) Int. Cl.

| | |
|---|---|
| ***E21B 10/43*** | (2006.01) |
| ***E21B 10/55*** | (2006.01) |
| ***E21B 10/50*** | (2006.01) |
| *E21B 10/42* | (2006.01) |

(52) U.S. Cl.

CPC ..... *E21B 10/55* (2013.01); *E21B 10/43* (2013.01); *E21B 10/50* (2013.01); *E21B 2010/425* (2013.01)

(58) Field of Classification Search

CPC ..... E21B 10/55; E21B 10/627; E21B 10/633

See application file for complete search history.

(56) References Cited

U.S. PATENT DOCUMENTS

| | | | | |
|---|---|---|---|---|
| 5,460,233 | A | 10/1995 | Meany | |
| 5,558,170 | A | 9/1996 | Thigpen | |
| 7,416,035 | B2 | 8/2008 | Viswanadham | |
| 9,303,460 | B2 | 4/2016 | Schwefe | |
| 9,605,486 | B2 * | 3/2017 | Burhan | E21B 10/50 |
| 9,739,097 | B2 | 8/2017 | Zhang | |
| 2009/0020339 | A1 * | 1/2009 | Sherwood, Jr. | E21B 10/43 175/426 |
| 2014/0054094 | A1 * | 2/2014 | Burhan | E21B 10/50 175/354 |

* cited by examiner

*Primary Examiner* — Giovanna C Wright

(57) ABSTRACT

A bit for drilling a wellbore, includes: a bit body; and a cutting face having an inner cone section and an outer shoulder section. The cutting face includes: a plurality of blades protruding from a bottom of the bit body, each blade extending from a center of the cutting face to the shoulder section; and a plurality of shear cutters mounted along leading edges of the blades. An inner shear cutter of each blade is located in the cone section. Each inner shear cutter includes: a superhard cylindrical cutting table; and a hard substrate having a cylindrical portion attached to the cutting table and a reduced portion extending therefrom. A diameter of the cutting table and the cylindrical portion is greater than a diameter of a majority of the reduced portion. A length of the reduced portion is at least twice that of the cylindrical portion.

14 Claims, 3 Drawing Sheets

DRILL BIT HAVING SHEAR CUTTERS WITH REDUCED DIAMETER SUBSTRATE

BACKGROUND OF THE DISCLOSURE

Field of the Disclosure

The present disclosure generally relates a drill bit having shear cutters with a reduced diameter substrate.

Description of the Related Art

U.S. Pat. No. 5,558,170 discloses, at FIGS. 37A and 38 and col. 11, line 45-col. 13, line 15, a shaped cutter including a generally bullet shaped tungsten carbide body and a PDC cutting element secured thereto.

U.S. Pat. No. 7,416,035 discloses a shaped insert that includes a top portion, and a grip length, wherein the grip length is modified to have a non-uniform cross sectional area. In another case, a shaped insert includes a top portion, and a grip length, wherein the grip length is modified such that the insert is non-cylindrical. In another case, a shaped insert includes a top portion, and a grip length, wherein the grip length is coated in a non-uniform manner.

U.S. Pat. No. 9,303,460 discloses earth-boring tools including a cutting element mounted to a body that comprises a metal or metal alloy, such as steel. A cutting element support member is mounted to the body rotationally behind the cutting element. The cutting element support member has an at least substantially planar support surface at a first end thereof, and a lateral side surface extending from the support surface to an opposing second end of the cutting element support member. The cutting element has a volume of superabrasive material on a first end of a substrate, and a lateral side surface extending from the first end of the substrate to an at least substantially planar back surface. The at least substantially planar back surface of the cylindrical substrate abuts an at least substantially planar support surface of the cutting element support member.

US 2012/0273280 discloses a cutting element having a substrate; and an ultrahard material layer having a substantially planar upper surface disposed on an upper surface of the substrate; wherein at least a portion of the side surface between the upper surface of the substrate and a lower end of the substrate form at least one conic surface, wherein the at least one conic surface extends a height relative to the total height of the substrate and ultrahard material layer ranging from about 1:10 to 9:10, and wherein the substrate comprises a substantially planar lower surface. The cutting elements may also be rotatable cutting elements at least partially surrounded by outer support elements.

SUMMARY OF THE DISCLOSURE

The present disclosure generally relates to a drill bit having shear cutters with a reduced diameter substrate. In one embodiment, a bit for drilling a wellbore, includes: a bit body; and a cutting face having an inner cone section and an outer shoulder section. The cutting face includes: a plurality of blades protruding from a bottom of the bit body, each blade extending from a center of the cutting face to the shoulder section; and a plurality of shear cutters mounted along leading edges of the blades. An inner shear cutter of each blade is located in the cone section. Each inner shear cutter includes: a superhard cylindrical cutting table; a hard substrate having a cylindrical portion attached to the cutting table and a reduced portion extending therefrom. A diameter of the cutting table and the cylindrical portion is greater than a diameter of a majority of the reduced portion. A length of the reduced portion is at least twice that of the cylindrical portion.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
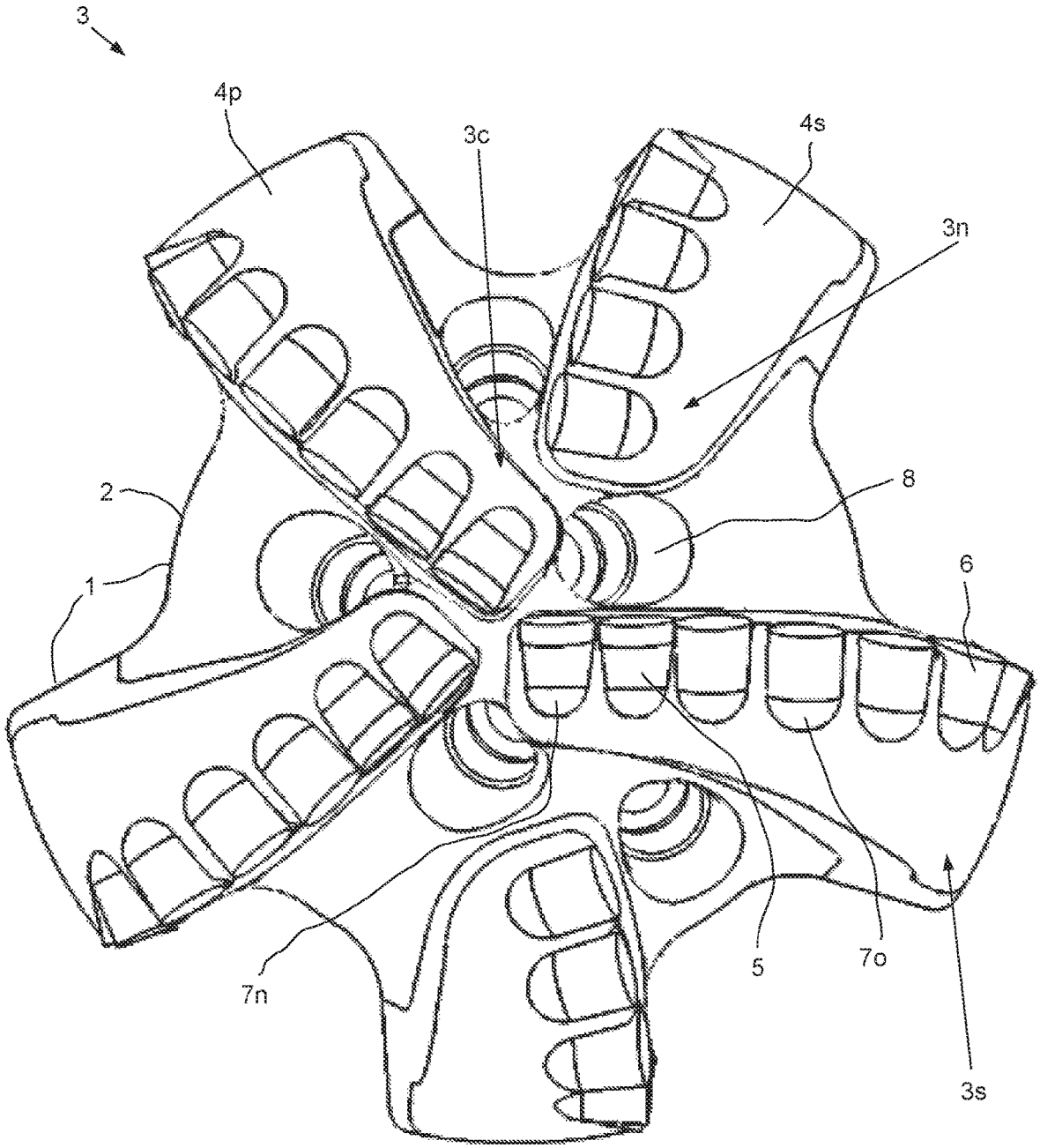
FIG. 1 illustrates a drill bit, according to one embodiment of the present disclosure.

FIG. 1 illustrates a drill bit, according to one embodiment of the present disclosure. The drill bit 1 may include a bit body 2, a shank (not shown), a cutting face 3, and a gage section (not shown). The shank may be tubular and include an upper piece and a lower piece connected to the upper piece, such as by threaded couplings secured by a weld. The bit body 2 may be made from a composite material, such as a ceramic and/or cermet body powder infiltrated by a metallic binder. The bit body 2 may be mounted to the lower shank piece during molding thereof. The shank 3 may be made from a metal or alloy, such as steel, and have a coupling, such as a threaded pin, formed at an upper end thereof for connection of the drill bit 1 to a drill collar (not shown). The shank may have a flow bore formed therethrough and the flow bore may extend into the bit body 2 to a plenum thereof. The cutting face 3 may form a lower end of the drill bit 1 and the gage section may form at an outer portion thereof.

Alternatively, the bit body 2 may be metallic, such as being made from steel, and may be hardfaced. The metallic bit body may be connected to a modified shank by threaded couplings and then secured by a weld or the metallic bit body may be monoblock having an integral body and shank.

The cutting face 3 may include one or more (three shown) primary blades 4*p*, one or more (two shown) secondary blades 4*s*, fluid courses formed between the blades, inner shear cutters 5, and outer shear cutters 6. The cutting face 3 may have one or more sections, such as an inner cone 3*c*, an outer shoulder 3*s*, and an intermediate nose 3*n* between the cone and the shoulder sections. The blades 4*p,s* may be disposed around the cutting face and each blade may be formed during molding of the bit body 2 and may protrude from a bottom of the bit body. The primary blades 4*p* may each extend from a center of the cutting face, across the cone 3*c* and nose 3*n* sections, along the shoulder section 3*s*, and to the gage section. The secondary blades 4*s* may each extend from a periphery of the cone section 3*c*, across the nose section 3*n*, along the shoulder section 3*s*, and to the gage section. Each blade 4*p,s* may extend generally radially across the cone 3*c* (primary only) and nose 3*n* sections with a slight spiral curvature and along the shoulder section 3*s* generally longitudinally with a slight helical curvature. Each blade 4*p,s* may be made from the same material as the bit body 2.

The inner 5 and outer 6 shear cutters may be mounted along leading edges of the primary blades 3*p*. The inner 5 and outer 6 shear cutters may be mounted, such as by brazing, in respective inner 7*n* and outer 7*o* pockets formed in the primary blades 3*p*. Each primary blade 3*p* may have one or more (pair shown) inner cutters 5. The inner pockets 7*n* may be formed in portions of the primary blades 3*p* extending across the cone section 3*c* and the outer pockets 7*o* may be formed in portions of the blades 3*p,s* extending across the nose section 3*n* and along the shoulder section 3*s*. The outer shear cutters 6 may also be mounted along leading edges of the secondary blades 3*s*. The outer shear cutters 6 may be mounted, such as by brazing, in outer 7*o* pockets formed in the secondary blades 3*s*.

Each outer shear cutter 6 may include a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal. The substrate and the cutting table may each be solid and cylindrical and a diameter of the substrate may be equal to a diameter of the cutting table.

Alternatively, the drill bit 1 may include backup cutters mounted in pockets formed along of portions of the blades 4*p,s* in the shoulder section 3*s*, such as by brazing. The backup cutters may also extend into portions of the blades 4*p,s* in the nose section 3*n*. Each backup cutter may be aligned with or slightly offset from a respective outer cutter 6.

One or more (five shown) ports 8 may be formed in the bit body 2 and each port may extend from the plenum and through the bottom of the bit body to discharge drilling fluid (not shown) along the fluid courses. A nozzle (not shown) may be disposed in each port 8 and fastened to the bit body 2. The ports 8 may include an inner set of one or more (three shown) ports disposed mostly in the cone section 3*c* and an outer set of one or more (two shown) ports disposed mostly in the nose section 3*n*.

The gage section may include a plurality of gage pads and junk slots formed between the gage pads. The junk slots may be in fluid communication with the fluid courses formed between the blades 4*p,s*. The gage pads may be disposed around the gage section and each pad may be formed during molding of the bit body 2 and may protrude from the outer portion of the bit body. Each gage pad may be made from the same material as the bit body 2 and each gage pad may be formed integrally with a respective blade 4*p,s*.

Figure 2A:
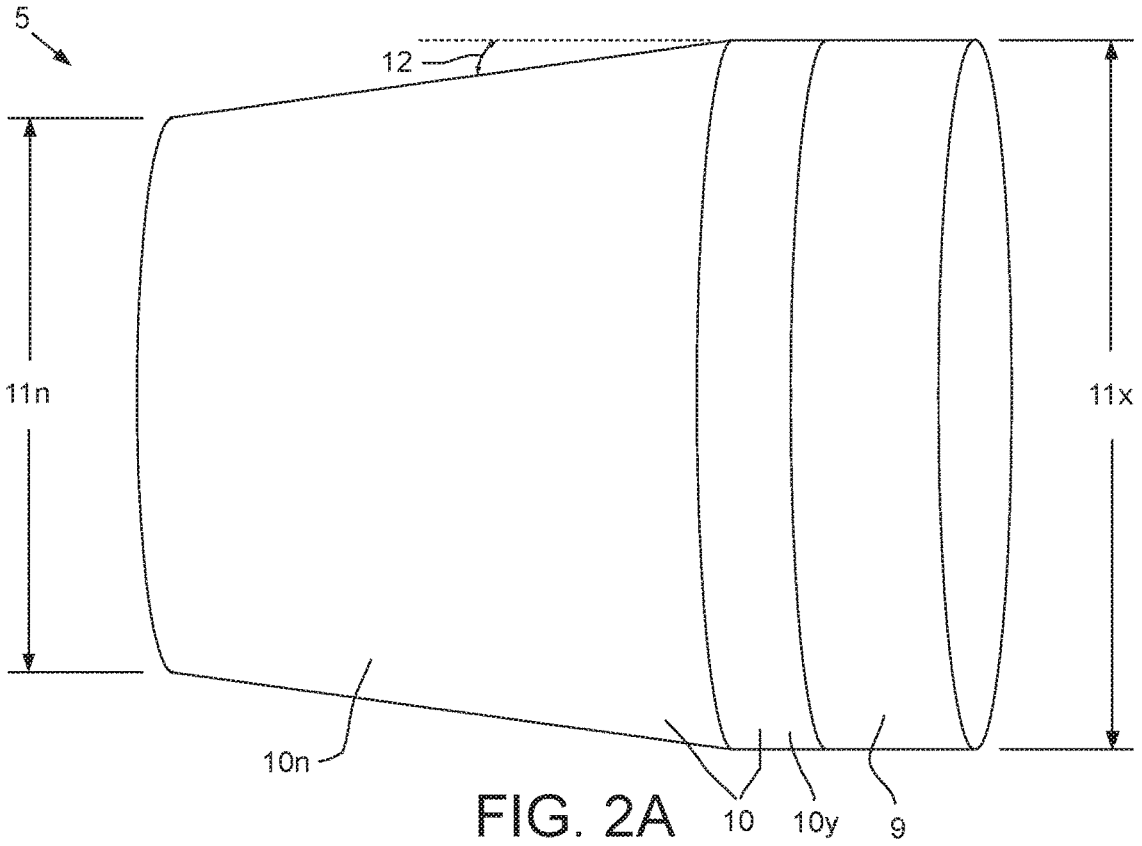
FIG. 2A illustrates an inner shear cutter of the drill bit with a reduced diameter substrate.

FIG. 2A illustrates a typical one of the inner shear cutters 5 of the drill bit 1. The inner shear cutter 5 may include a superhard cutting table 9, such as polycrystalline diamond, attached to a hard substrate 10, such as a cermet, thereby forming a compact, such as a polycrystalline diamond compact (PDC). The cermet may be a carbide cemented by a Group VIIIB metal. The cutting table 9 may be solid and cylindrical having a maximum diameter 11*x* of the inner shear cutter 5.

The substrate 10 may be solid and have a cylindrical portion 10*y* located adjacent to the cutting table 9 and a truncated conical portion 10*n* converging away from the cylindrical portion to a minimum diameter 11*n* at an end thereof received in the inner pocket 7*n*. The cylindrical portion 10*y* may have a diameter equal to the maximum diameter 11*x*. The minimum diameter 11*n* may range between fifty and ninety percent or between sixty and eighty percent of the maximum diameter 11*x*. The conical portion 10*n* may converge at an angle 12 (relative to a dimension line, shown in phantom, parallel to a longitudinal axis of the cutter 5) ranging between five and forty-five degrees or between five and fifteen degrees. A size of the inner pocket 7*n* may be reduced to accommodate the reduced diameter of the conical portion 10*n*.

A length of the cylindrical portion 10*y* may be minimized to that sufficient to maintain structural support of the cutting table 9. The length of the cylindrical portion 10*y* may range between twenty-five and one-hundred fifty percent or between forty and one-hundred percent a length of the cutting table 9. A length of the conical portion 10*n* may be substantially greater than a length of the cylindrical portion 10*y*, such as greater than or equal to twice, thrice, four times, five times, six times, seven times, eight times, nine times, or ten times the length of the cylindrical portion.

A diameter of the outer cutters 6 may be equal to the maximum diameter 11*x*.

Figure 3:
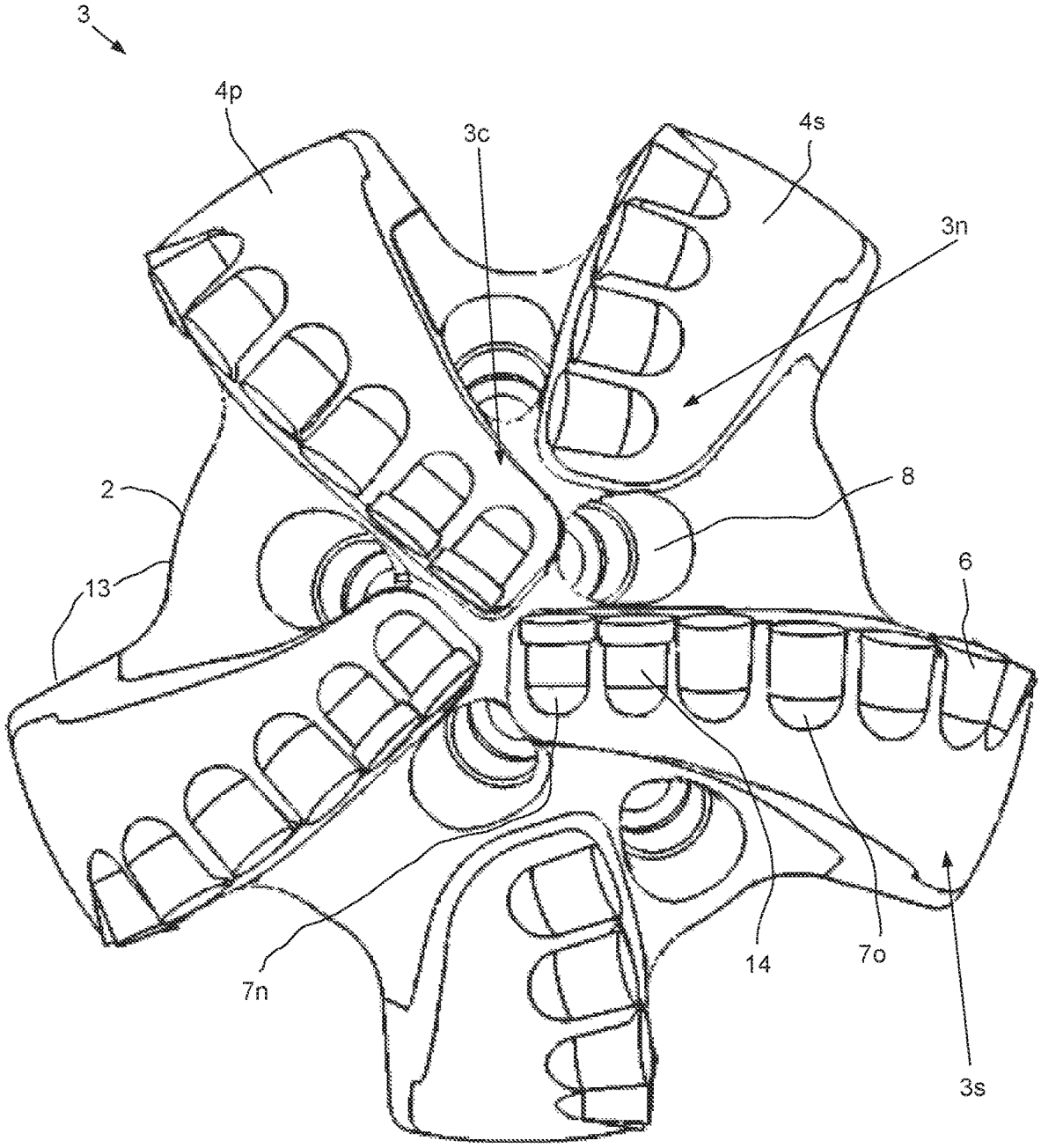
FIG. 3 illustrates the alternative drill bit.

FIG. 3 illustrates an alternative drill bit 13, according to another embodiment of the present disclosure. The alternative drill bit 13 may include the bit body 2, the shank (not shown), the cutting face 3, and the gage section (not shown). The cutting face 3 may include the primary blades 4*p*, the secondary blades 4*s*, the fluid courses formed between the blades, inner shear cutters 14, and the outer shear cutters 6. The cutting face 3 may have the inner cone section 3*c*, the outer shoulder section 3*s*, and the intermediate nose section 3*n* between the cone and the shoulder sections.

Figure 2B:
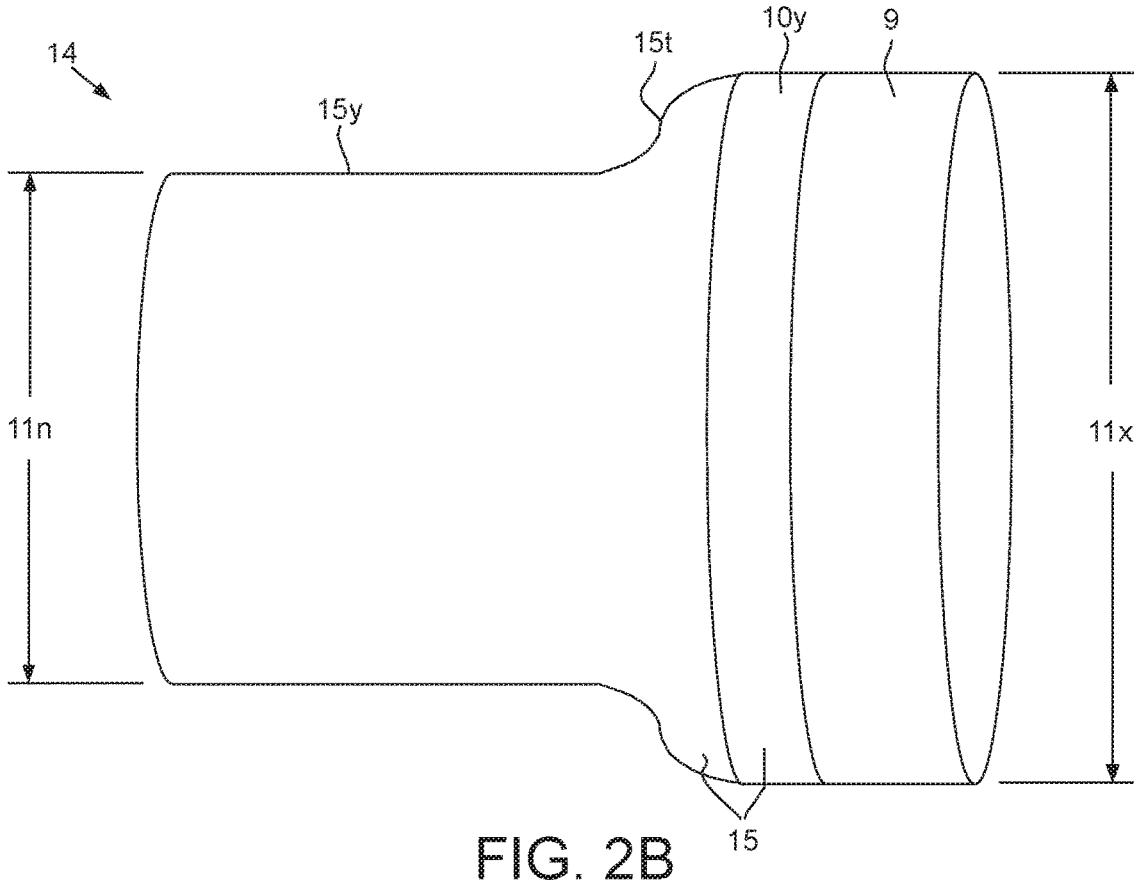
FIG. 2B illustrates an inner shear cutter of an alternative drill bit with a reduced diameter substrate, according to another embodiment of the present disclosure.

FIG. 2B illustrates a typical one of the inner shear cutters 14 of the alternative drill bit 1. The inner shear cutter 14 may include the superhard cutting table 9 attached to a hard substrate 15, such as a cermet, thereby forming a compact, such as a polycrystalline diamond compact (PDC). The cermet may be a carbide cemented by a Group VIIIB metal.

The substrate 15 may be solid and have the cylindrical portion 10*y* located adjacent to the cutting table 9, a transition portion 15*t* located adjacent to the cylindrical portion, and a reduced cylindrical portion 15*y* extending away from the transition portion to an end thereof received in the inner pocket 7*n*. The reduced cylindrical portion 15*y* may have a diameter equal to the minimum diameter 11*n*. The transition portion 15*t* may be curved to minimize stress concentration occurring from the change in diameter from the maximum 11*x* to the minimum 11*n*. A cross-section of the transition portion 15*t* may include a round connected to the cylindrical portion 10*y* and a fillet connected to the reduced cylindrical portion 15*y*, thereby resembling an S-shape.

A length of the transition portion 15*t* may be minimized to that sufficient to minimize the stress concentration. The length of the transition portion 15*t* may range between seventy-five and one-hundred twenty-five percent a length of the cutting table 9. A length of the reduced cylindrical portion 15*y* may be substantially greater than a length of the cylindrical portion 10*y*, such as greater than or equal to twice, thrice, four times, five times, six times, seven times, eight times, nine times, or ten times the length of the cylindrical portion.

In use (not shown), either drill bit 1, 13 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The pipe string may be used to deploy the BHA into a wellbore. Either drill bit 1, 13 may be rotated, such as by rotation of the drill string from a rig (not shown) and/or by a drilling motor (not shown) of the BHA, while drilling fluid, such as mud, may be pumped down the drill string. A portion of the weight of the drill string may be set on either drill bit 1, 13. The drilling fluid may be discharged by either drill bit 1, 13 and carry cuttings up an annulus formed between the drill string and the wellbore and/or between the drill string and a casing string and/or liner string.

Advantageously, shear cutters that are subjected to a large depth of cut and large angular displacement (cone cutters) tend to exhibit high wear and formation contact on the cutter substrates. A reduction in substrate diameter while maintaining the original cutting table diameter will help reduce substrate wear and detrimental damage to the cutter. A narrowed/tapered substrate diameter will reduce formation contact in high depth of cut situations in primarily but not limited to the cone section of the cutting face. Cutter exposure, from the primary blades, can be increased over standard cutter substrates which do not deviate from the active cutting element or diamond table diameter. Bit performance will be increased as applied energy to the inner shear cutters is directed to the active removal of formation rather than the wearing of the substrate. Heat generated by substrate contact/wear on a standard cutter can induce thermal cycling, heat checking, cutting table and substrate degradation, cracking and cutter fallout. A narrowed/tapered substrate will help mitigate/reduce the severity of these problems.

Alternatively, either inner cutter 5, 14 may be deployed in the shoulder section 3*s* instead of or in addition to being deployed in the cone section 3*c*. In this alternative, the inner cutters 5, 14 may be utilized on both the primary and secondary blades 4*p,s*.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a bit body; and a cutting face having an inner cone section and an outer shoulder section, and comprising:

a plurality of blades protruding from a bottom of the bit body, each blade extending from a center of the cutting face to the shoulder section; and a plurality of shear cutters mounted along leading edges of the blades, wherein:

an inner shear cutter of each blade is located in the cone section, each inner shear cutter comprises:

a superhard cylindrical cutting table; and a hard substrate having a cylindrical portion attached to the cutting table and a reduced portion extending therefrom, a diameter of the cutting table and the cylindrical portion is greater than a diameter of a majority of the reduced portion, a length of the reduced portion is at least twice that of the cylindrical portion, each shear cutter is mounted in a pocket formed in the respective blade; and each pocket of the respective inner shear cutter has a reduced size relative to other pockets to accommodate the smaller diameter of the reduced portion.

2. The bit of claim 1, wherein the reduced portion has a truncated conical shape converging from the cylindrical portion.

3. The bit of claim 2, wherein a minimum diameter of the reduced portion ranges between fifty and ninety percent of the diameter of the cutting table and the cylindrical portion.

4. The bit of claim 3, wherein the minimum diameter of the reduced portion ranges between sixty and eighty percent of the diameter of the cutting table and the cylindrical portion.

5. The bit of claim 1, wherein the reduced portion has a transition portion adjacent to the cylindrical portion and a reduced cylindrical portion extending therefrom.

6. The bit of claim 5, wherein a diameter of the reduced cylindrical portion ranges between fifty and ninety percent of the diameter of the cutting table and the cylindrical portion.

7. The bit of claim 6, wherein the minimum diameter of the reduced cylindrical portion ranges between sixty and eighty percent of the diameter of the cutting table and the cylindrical portion.

8. The bit of claim 1, wherein:

each blade has a pair of the inner shear cutters, and a rest of the cutters of the blades each comprise:

a superhard cylindrical cutting table; and a hard cylindrical substrate having a diameter equal to that of the cutting table.

9. The bit of claim 1, wherein:

the cutting face further has an intermediate nose section between the cone and the shoulder sections, and each blade extends from a center of the cutting face across the cone and nose sections and along the shoulder section.

10. The bit of claim 1, wherein:

each blade is a primary blade, the bit further comprises a secondary blade extending from a periphery of the cone section to the shoulder section, and the inner shear cutters are located only on the primary blades.

11. The bit of claim 1, wherein:

the bit further comprises:

a shank having a coupling formed at an upper end thereof; and a gage section forming an outer portion of the drill bit, and the bit body is mounted to a lower end of the shank.

12. The bit of claim 1, wherein:

the cutting face further has fluid courses are formed between the blades, the bit body has a plenum formed therein, the bit further comprises a plurality of ports formed in the bit body, and each port extends from the plenum and through the bottom of the bit body to discharge drilling fluid along the fluid courses.

13. The bit of claim 1, wherein each shear cutter is mounted in the respective pocket by brazing.

14. A method of drilling a wellbore using the bit of claim 1, comprising:

connecting the bit to a bottom of a pipe string, thereby forming a drill string;

lowering the drill string into the wellbore until the drill bit is proximate a bottom thereof;

rotating the bit and injecting drilling fluid through the drill string; and exerting weight on the bit.

* * * * *